US011217887B2

(12) United States Patent
Li et al.

(10) Patent No.: US 11,217,887 B2
(45) Date of Patent: Jan. 4, 2022

(54) ANTENNA MODULE

(71) Applicants: Inventec (Pudong) Technology Corporation, Shanghai (CN); INVENTEC CORPORATION, Taipei (TW)

(72) Inventors: Chih-Cheng Li, Taipei (TW); Ssu-Han Ting, Taipei (TW)

(73) Assignees: Inventec (Pudong) Technology Corporation, Shanghai (CN); INVENTEC CORPORATION, Taipei (TW)

( * ) Notice: Subject to any disclaimer, the term of this patent is extended or adjusted under 35 U.S.C. 154(b) by 0 days.

(21) Appl. No.: 16/902,283

(22) Filed: Jun. 16, 2020

(65) Prior Publication Data

US 2021/0376459 A1 Dec. 2, 2021

(30) Foreign Application Priority Data

Jun. 2, 2020 (CN) ..... 202010490475.9

(51) Int. Cl.
*H01Q 1/48* (2006.01)
*H01Q 9/04* (2006.01)

(52) U.S. Cl.
CPC ..... *H01Q 1/48* (2013.01); *H01Q 9/0457* (2013.01)

(58) Field of Classification Search
CPC ..... H01Q 1/24–1/48; H01Q 9/0407; H01Q 9/0457; H01Q 1/243
See application file for complete search history.

(56) References Cited

U.S. PATENT DOCUMENTS

| | | | | |
|---|---|---|---|---|
| 10,910,698 | B2 * | 2/2021 | Wei | H01Q 1/244 |
| 2008/0258992 | A1 * | 10/2008 | Tsai | H01Q 1/2266 343/853 |
| 2015/0002359 | A1 * | 1/2015 | Dong | H01Q 1/243 343/853 |
| 2018/0006369 | A1 * | 1/2018 | Higaki | H01Q 3/247 |
| 2020/0021029 | A1 * | 1/2020 | Chou | H01Q 9/04 |

FOREIGN PATENT DOCUMENTS

| | | | |
|---|---|---|---|
| TW | 201303560 | A | 1/2013 |
| TW | 201611408 | A | 3/2016 |
| TW | 202007097 | A | 2/2020 |

* cited by examiner

*Primary Examiner* — Hasan Islam
(74) *Attorney, Agent, or Firm* — CKC & Partners Co., LLC

(57) ABSTRACT

An antenna module includes a grounding plane, a first high-frequency radiator, a second high-frequency radiator, and a low-frequency grounding component. The first high-frequency radiator includes a first feeding portion, a first grounding portion, and a first radiating portion. The first grounding portion is coupled to the grounding plane. The second high-frequency radiator includes a second feeding portion, a second grounding portion, and a second radiating portion. The second grounding portion is coupled to the grounding plane. The low-frequency grounding component located between the first and second high-frequency radiators. The low-frequency grounding component includes a third grounding portion which is coupled to the grounding plane, a first coupling portion, and a second coupling portion. The low-frequency grounding component extends from the third grounding portion and extends in a first direction and a second direction of a first axis respectively to form the first and second coupling portions.

8 Claims, 5 Drawing Sheets

ANTENNA MODULE

CROSS-REFERENCE TO RELATED APPLICATION

This application claims priority to China Application Serial Number 202010490475.9, filed Jun. 2, 2020, which is herein incorporated by reference in its entirety.

BACKGROUND

Field of Invention

The present invention relates to an antenna module. More particularly, the present invention relates to a dual antenna module.

Description of Related Art

It is known that a dual antenna module is easily affected by surrounding conductors, and thus operating frequency bands of the dual antenna are changed. As a result, the design of the dual antenna module must avoid the surrounding conductors.

In order to prevent the negative influence from the conductors, an electric device equipped with the dual antenna module has little choices for its materials. For instance, in consideration of affecting operating frequency bands, a metal shell can't be applied to a smart phone or a tablet computer equipped the dual antenna module.

Therefore, research in various industries has been focused on ways to develop an innovative dual antenna module which can solve the above mentioned problems.

SUMMARY

An aspect of the disclosure is to provide an antenna module which can effectively solve the aforementioned problems.

According to an embodiment of the present disclosure, an antenna module is provided. Such antenna module includes a grounding plane, a first high-frequency radiator, a second high-frequency radiator, and a low-frequency grounding component. The first high-frequency radiator includes a first feeding portion, a first grounding portion, and a first radiating portion in which the first grounding portion is coupled to the grounding plane. The second high-frequency radiator includes a second feeding portion, a second grounding portion, and a second radiating portion in which the second grounding portion is coupled to the grounding plane. The low-frequency grounding component located between the first and second high-frequency radiators. The low-frequency grounding component includes a third grounding portion which is coupled to the grounding plane, a first coupling portion, and a second coupling portions. The low-frequency grounding component extends starting from the third grounding portion and extends in a first direction and a second direction of a first axis respectively to form the first and second coupling portions. The first direction is opposite to the second direction, and the first radiating portion extending in the first direction is radiationally coupled with the first coupling portion. The second radiation extending in the second direction is radiationally coupled with the second coupling portion. The first and second radiating portions are located at a side of the low-frequency grounding component where the first and second coupling portions face the third grounding portion in a second axis which is perpendicular to the first axis and parallel to the grounding plane.

In some embodiments of the present disclosure, the first high-frequency radiator, the second high-frequency radiator, and the low-frequency grounding component are bent to extend in a third direction of the second axis.

In some embodiments of the present disclosure, the first grounding portion, the second grounding portion, and the third grounding portion are arranged in a straight row along the first axis A.

In some embodiments of the present disclosure, top surfaces of the first radiating portion, the second radiating portions, the first coupling portion, and the second coupling portion are coplanar.

In some embodiments of the present disclosure, the low-frequency component includes a capacitor located among the first coupling portion, the second coupling portion, and the third grounding portion.

In some embodiments of the present disclosure, the capacitor is a chip capacitor, a distributed capacitor, or a lumped capacitor.

In some embodiments of the present disclosure, the first radiating portion and the first coupling portion are spaced by a distance equal to or less than 0.5 mm. The second radiating portion and the second coupling portion are spaced by a distance equal to or less than 0.5 mm.

In some embodiments of the present disclosure, the antenna module further includes a metal shell. The first high-frequency radiator, the second high-frequency radiator, and the low-frequency grounding component are located in the metal shell.

In some embodiments of the present disclosure, the metal shell includes an opening, and the first high-frequency radiator, the second high-frequency radiator, and the low-frequency grounding component are located between the opening and the grounding plane.

In some embodiments of the present disclosure, the antenna module further includes a dielectric cap covering the opening of the metal shell.

In conclusion, the antenna module provided in the present disclosure has a low-frequency component radiationally connected with a first high-frequency radiator and a second high-frequency radiator, and the low-frequency is located between the first and second high-frequency radiators. Through such configuration of the low-frequency component, the first high-frequency radiator, and the second high-frequency radiator, the first and second high-frequency radiators are less affected by a surrounding conductor. A metal shell or a conductive structure can be located around the first and second high-frequency radiators. In this way, the provided antenna module is applied to a smart phone, a tablet computer, or a laptop computer equipped with a metal shell.

It is to be understood that both the foregoing general description and the following detailed description are by examples, and are intended to provide further explanation of the invention as claimed.

BRIEF DESCRIPTION OF THE DRAWINGS

The invention can be more fully understood by reading the following detailed description of the embodiment, with reference made to the accompanying drawings as follows.

DETAILED DESCRIPTION

Figure 1:
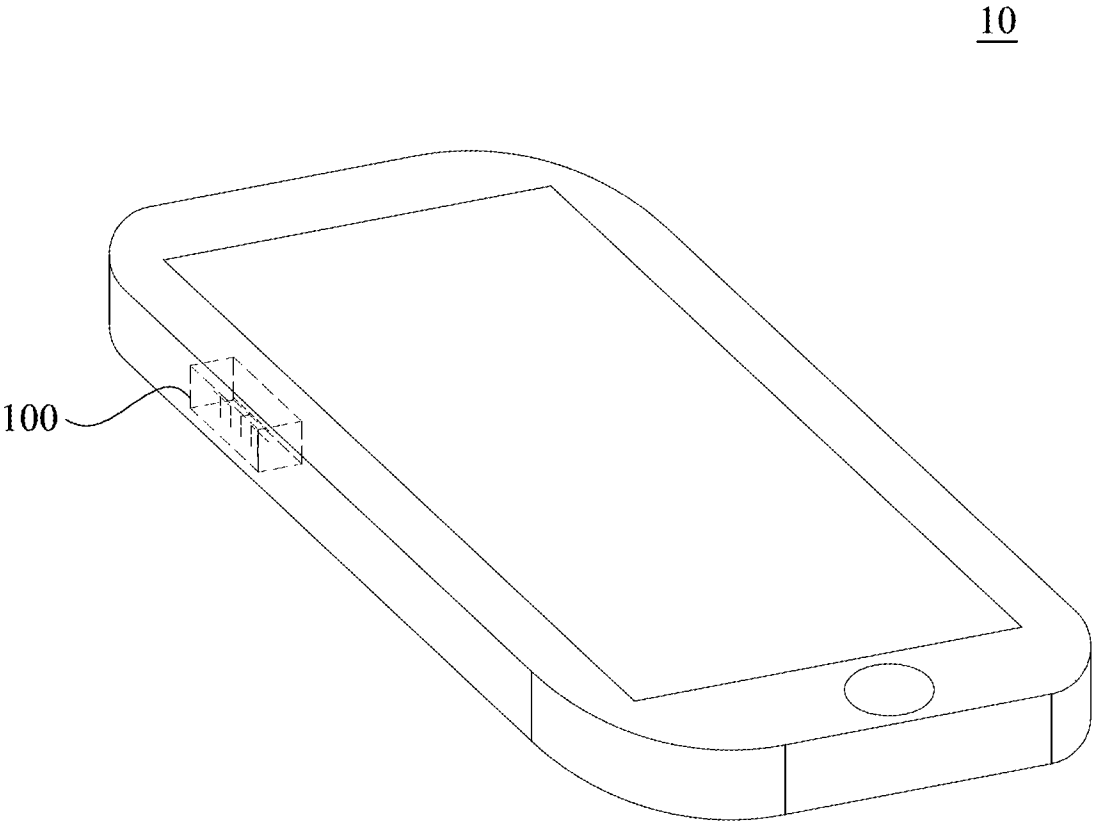
FIG. 1 is a schematic diagram of an electric device equipped with an antenna module according to embodiments of the present disclosure.

Reference will now be made in detail to the present embodiments of the invention, examples of which are illustrated in the accompanying drawings. Wherever possible, the same reference numbers are used in the drawings and the description to refer to the same or like parts.

Although the terms "first," "second," etc., may be used herein to describe various elements, these elements should not be limited by these terms. These terms are used to distinguish one element from another. For example, a first element could be termed a second element, and, similarly, a second element could be termed a first element, without departing from the scope of the embodiments. As used herein, the term "and/or" includes any and all combinations of one or more of the associated listed items.

The terms "comprise," "comprising," "include," "including," "has," "having," etc. used in this specification are open-ended and mean "comprises but not limited."

Reference is made to FIG. 1. FIG. 1 is a schematic diagram of an electric device 10 equipped with an antenna module 100. The electric device 10 is a smart phone, a laptop computer, or any suitable communication device, and the present disclosure is not limited in this respect.

Figure 2:
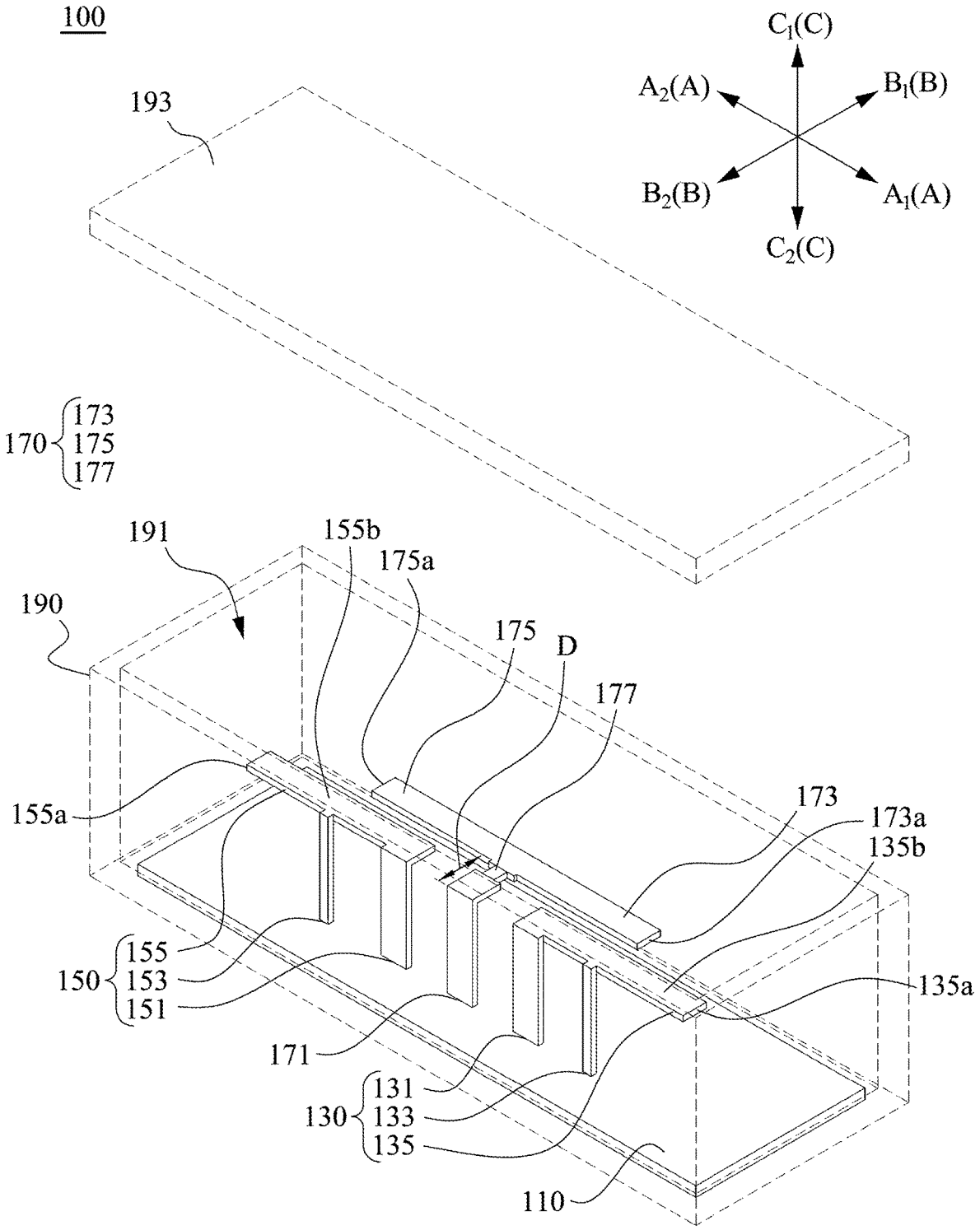
FIG. 2 is a schematic diagram of the antenna module in FIG. 1 according to some embodiments of the present disclosure.

Reference is made to FIG. 2. FIG. 2 is a schematic diagram of the antenna module 100 in FIG. 1. In some embodiments of the present disclosure, the antenna module 100 includes a grounding plane 110, a first high-frequency radiator 130, a second high-frequency radiator 150, and a low-frequency grounding component 170. The grounding plane 110 has grounding function, and the grounding plane 110 is a plane of a circuit board or a grounding conductor in the electric device 10. The present disclosure is not limited in this respect.

The first high-frequency radiator 130 includes a first feeding portion 131, a first grounding portion 133, and a first radiating portion 135. Electric currents can be fed into the first feeding portion, and the first grounding portion 133 is coupled to the grounding plane 110. The second high-frequency radiator 150 includes a second feeding portion 151, a second grounding portion 153, and a second radiating portion 155. Electric currents can be fed into the second feeding portion 151, and the second grounding portion 153 is coupled to the grounding plane 110. The low-frequency grounding component 170 is between the first high-frequency radiator 130 and the second high-frequency radiator 150. The low-frequency grounding component 170 includes a third grounding portion 171, a first coupling portion 173, and a second coupling portions 175. The third grounding portion 171 is coupled to the grounding plane 110. The low-frequency grounding component 170 extends starting from the third grounding portion 171 and extends in a first direction $A_1$ and a second direction $A_2$ of a first axis A respectively to form the first coupling portion 173 and the second coupling portion 175. The first axis A is parallel to the grounding plane 110, and the first direction $A_1$ is opposite to the second direction $A_2$. The first radiating portion 135 extending in the first direction $A_1$ is radiationally coupled with the first coupling portion 173. The second radiating portion 155 extending in the second direction $A_2$ is radiationally coupled with the second coupling portion 175. The first radiating portion 135 and the second radiating portion 155 are located at a side of the low-frequency grounding component 170 where the first coupling portion 173 and the second coupling portion 175 face the third grounding portion 171 in a second axis B. The second axis B is perpendicular to the first axis A and parallel to the grounding plane 110.

"Radiationally coupled" in the present disclosure refers to the phenomenon in which when a radiating part approaches an object (a conductor generally), a signal path is generated from a signal feeding point through a radiationally coupling point to the ground.

Specifically, the first high-frequency radiator 130 and the second high-frequency radiator 150 are monopole antennas such as planar inverted F-shaped antennas having resonance frequency at about 5 GHz. The low-frequency grounding component 170 is a loop antenna having resonance frequency at about 2.4 GHz. The configuration of the first high-frequency radiator 130, the second high-frequency radiator 150, and the low-frequency grounding component 170 can prevent a surrounding conductor from affecting the first high-frequency radiator 130 and the second high-frequency radiator 150. In this way, the antenna module 100 can maintain its frequency bands when a conductor is located around the antenna module 100.

Figure 3:
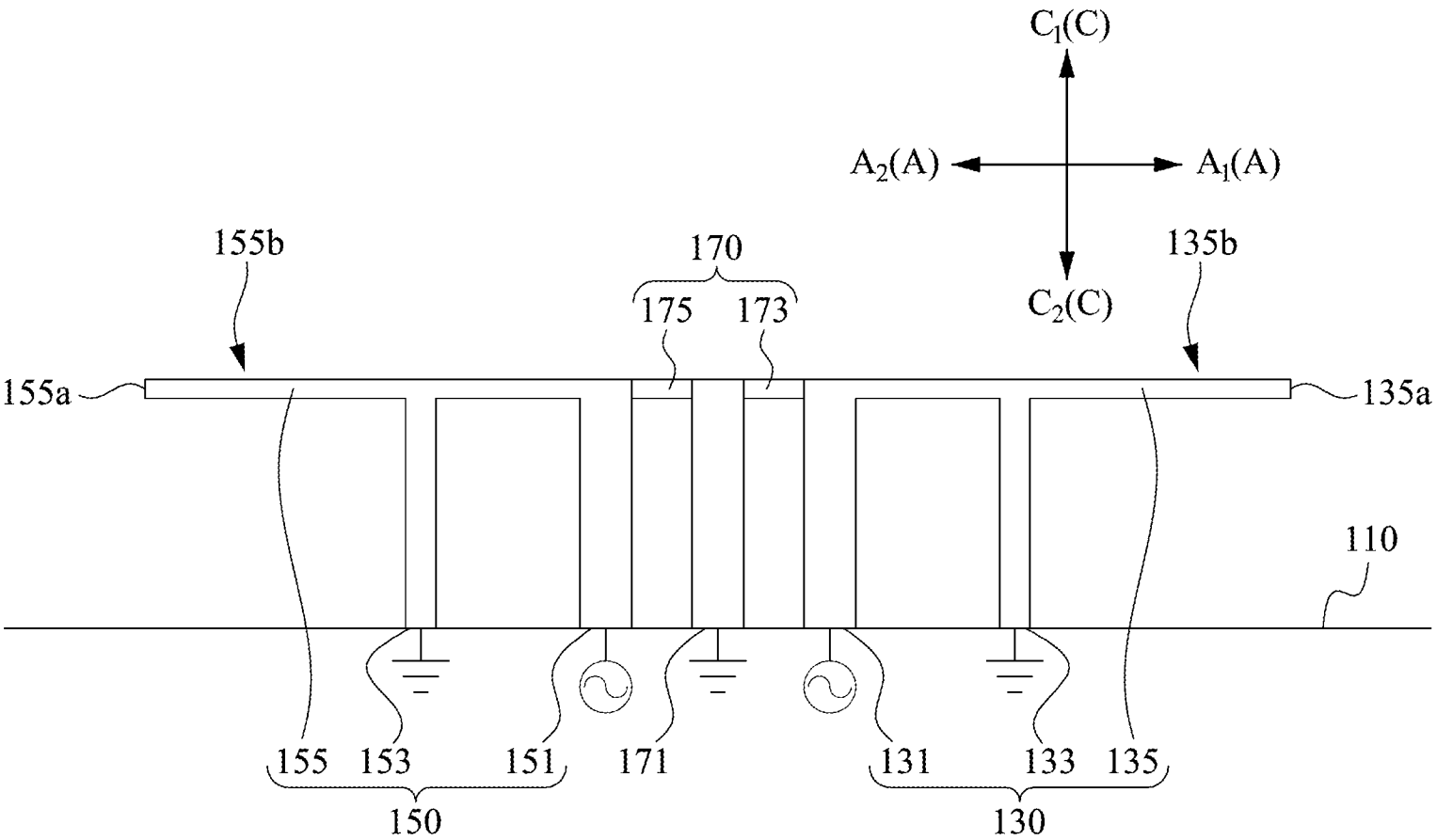
FIG. 3 is a front view of the antenna module shown in FIG. 2.
Figure 4:
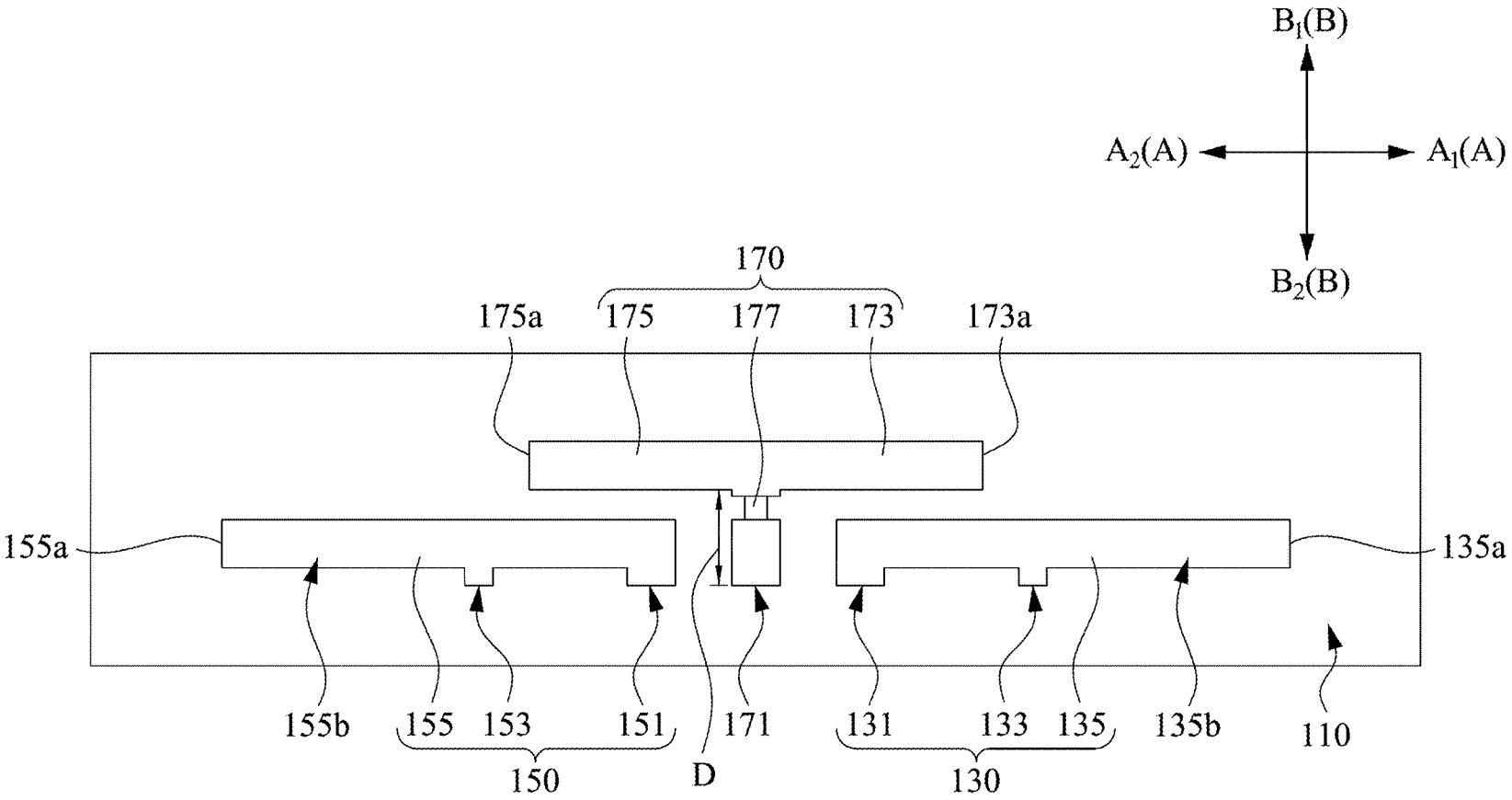
FIG. 4 is a top view of the antenna module shown in FIG. 2.

Reference is made from FIG. 2 through FIG. 4. FIG. 3 is a front view of the antenna module 100 shown in FIG. 2. FIG. 4 is a top view of the antenna module 100 shown in FIG. 2. In some embodiments of the present disclosure, the first high-frequency radiator 130 extends starting from the first feeding portion 131 and the first grounding portion 133, and the first high-frequency radiator 130 bends and then extends in the first direction $A_1$ and the third direction $B_1$ as far as a first free end 135*a*, such that a first radiating top board 135*b* substantially parallel to the grounding plane 110 is formed. The second high-frequency radiator 150 extends starting from the second feeding portion 151 and the second grounding portion 153, and the second high-frequency radiator 150 bends and then extends in the second direction $A_2$ and the third direction $B_1$ as far as a second free end 155*a*, such that a second radiating top board 155*b* substantially parallel to the grounding plane 110 is formed. The low-frequency grounding component 170 extends starting from the third grounding portion 171, and the low-frequency grounding component 170 bends and then extends in a third direction $B_1$ by a distance D. Thereafter, the low-frequency grounding component 170 bends and then extends in the first direction $A_1$ and the second direction $A_2$ respectively as far as a third free end 173*a* and a fourth end 175*a*, such that the first coupling portion 173 and the second coupling portion 175 parallel to the grounding plane 110 are formed.

Specifically, each of the first radiating top board 135*b* and the second radiating top board 155*b* includes a rectangular surface which is parallel to the grounding plane 110, and such rectangular surface has a length from about 12 mm to about 15 mm and a width from about 1.2 mm to about 1.5 mm. Each of the first coupling portion 173 and the second coupling portion 175 includes a rectangular surface which is parallel to the grounding plane 110, and such rectangular surface has a length from about 15 mm to 20 mm and a width from about 1.8 mm to about 2.2 mm. The present disclosure is not limited in this respect.

In some embodiments of the present disclosure, each of the first high-frequency radiator 130, the second high-frequency radiator 150, and the low-frequency grounding component 170 has a height from about 2 mm to about 4 mm. That is to say, each of the first high-frequency radiator 130, the second high-frequency radiator 150, and the low-frequency grounding component 170 has a height from about 2 mm to about 4 mm in a third axis C which is perpendicular to the grounding plane 110.

In some embodiments of the present disclosure, the first high-frequency radiator 130, the second high-frequency radiator 150, and the low-frequency grounding component 170 have the same heights corresponding to the grounding plane 110. Therefore, the first radiating top board 135*b*, the second radiating top board 155*b*, the first coupling portion 173, and the second coupling portion 175 have coplanar top surfaces. In this way, the first high-frequency radiator 130 and the second high-frequency radiator 150 can avoid influence from a surrounding conductor.

Moreover, the first radiating top board 135*b* is radiationally coupled with the first coupling portion 173, and the second radiating top board 155*b* is radiationally coupled with the second coupling portion 175. The first coupling portion 173 and the second coupling portion 175 are located at the third direction $B_1$ of the first radiating top board 135*b* and the second radiating top board 155*b*. In contrast, the first radiating top board 135*b* and the second radiating top board 155*b* are located at in a fourth direction $B_2$ (opposite to the third direction $B_1$) of the first coupling portion 173 and the second coupling portion 175. In addition, the first radiating top board 135*b* and the first coupling portion 173 are spaced by a distance equal to or less than 0.5 mm in the second axis B, and the second radiating top board 155*b* and the second coupling portion 175 are spaced by a distance equal to or less than 0.5 mm in the second axis B, but the disclosure is not limited in this respect.

In some embodiments of the present disclosure, the first grounding portion 133, the second grounding portion 153, and the third grounding portion 171 are spaced apart and arranged in a straight row along the first axis A. The first feeding portion 131 is between the first grounding portion 133 and the third grounding portion 171. The second feeding portion 151 is between the second grounding portion 153 and the third grounding portion 171. The first feeding portion 131, the first grounding portion 133, the second feeding portion 151, and the second grounding portion 153 are arranged in a straight raw in the first axis A, but the present disclosure is not limited in this respect.

In some embodiments of the present disclosure, the low-frequency grounding component 170 includes a capacitor 177 located among the first coupling portion 173, the second coupling portion 175, and the third grounding portion 171. Specifically, the capacitor 177 is in the middle of the first coupling portion 173 and the second coupling portion 175. The capacitor 177 can be a chip capacitor, a distributed capacitor, or a lumped capacitor, but the present disclosure is not limited in this respect. The configuration of the capacitor 177 can increase isolation between the first high-frequency radiator 130 and the second high-frequency radiator 150.

Reference is made to FIG. 2. In some embodiments of the present disclosure, the antenna module 100 further includes a metal shell 190 (shown in dotted lines, and the dotted lines does not limit the shape or the structure of the metal shell 190 unless it is specifically defined). The first high-frequency radiator 130, the second high-frequency radiator 150, and the low-frequency grounding component 170 are inside the metal shell 190. The metal shell 190 can be an interior structure or an outer shell of the electric device 10 (shown in FIG. 1), but the disclosure is not limited in this respect. Since the first high-frequency radiator 130 and the second high-frequency radiator 150 are less affected by a surrounding conductor, the metal shell 190 can be located in a position adjacent to the first high-frequency radiator 130 and the second high-frequency radiator 150. Therefore, materials of the electric device 10 are more selective in the practical application.

Furthermore, the metal shell 190 has an opening 191 in which the first high-frequency radiator 130, the second high-frequency radiator 150, and the low-frequency grounding component 170 are located between the opening 191 and the grounding plane 110. The opening 191 can expose the first high-frequency radiator 130, the second high-frequency radiator 150, and the low-frequency grounding component 170 in the third axis C which has a fifth direction $C_1$ and a sixth direction $C_2$. The fifth direction $C_1$ is opposite to the sixth direction $C_2$. The antenna module 100 further includes a dielectric cap 193 covering the opening 191 along with the sixth direction C. In this case, the opening 191 is covered by the dielectric cap 193, and thus the first high-frequency radiator 130, the second high-frequency radiator 150, and the low-frequency grounding component 170 are not exposed, but the present disclosure is not limited in this respect.

Figure 5:
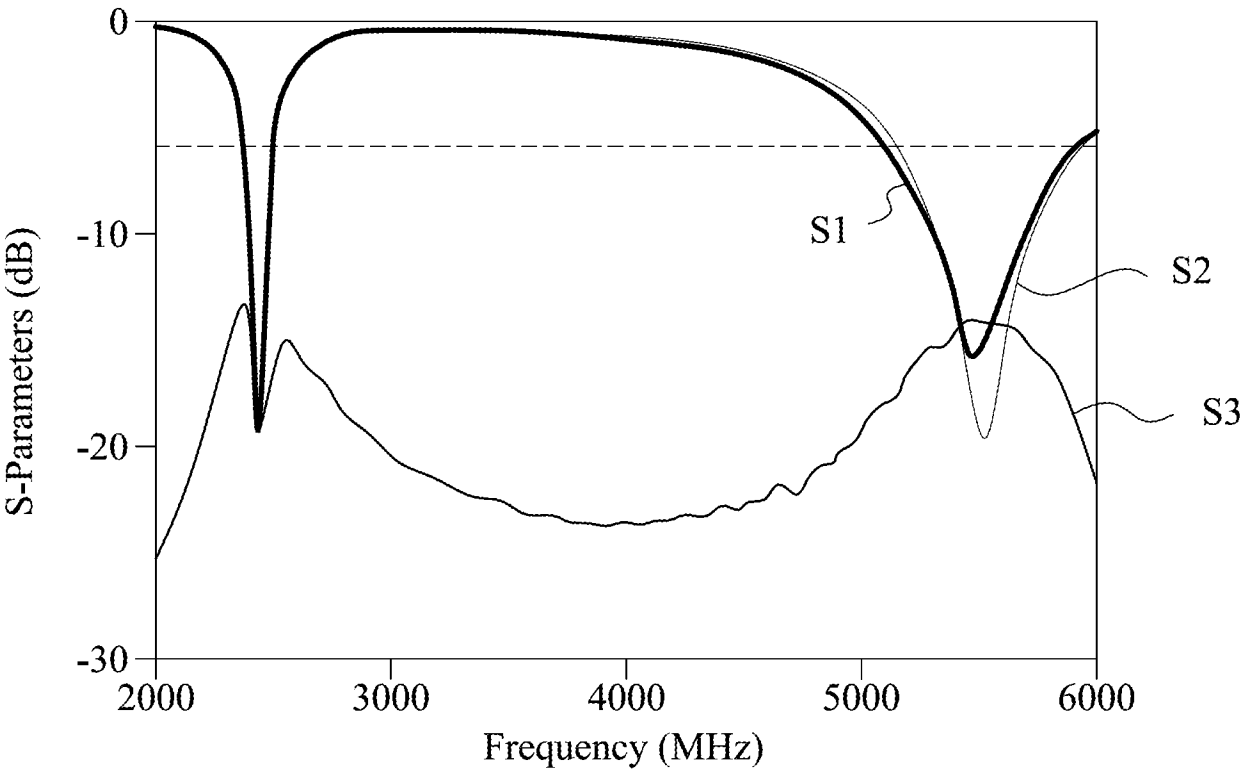
FIG. 5 is a comparison diagram of return loss about the antenna module according to some embodiments of the present disclosure.

Reference is made to FIG. 5. FIG. 5 is a comparison diagram of return loss about the antenna module 100 having the metal shell 190. The curve S1 shows a return loss value of the first high-frequency radiator 130 in different frequency. The curve S2 shows a return loss value of the second high-frequency radiator 150 in different frequency. The curve S1 and the curve S2 are substantially the same, and the difference occurs only in about the 5.5 GHz frequency band. In accordance with the curve S1 and the curve S2, although the first high-frequency radiator 130 and the second high-frequency radiator 150 are located in the metal shell 190, the antenna module 100 still operates well in desired frequencies bands.

In addition, the curve S3 shows the isolation between the first high-frequency radiator 130 and the second high-frequency radiator 150. As is evident from curve S3, there is good isolation between the first radiator 220 and the second radiator 230.

In conclusion, the antenna module provided in the present disclosure has a low-frequency component radiationally connected with a first high-frequency radiator and a second high-frequency radiator, and the low-frequency is located between the first and second high-frequency radiators. Through such configuration of the low-frequency component, the first high-frequency radiator, and the second high-frequency radiator, the first and second high-frequency radiators are less affected by a surrounding conductor. A metal shell or a conductive structure can be located around the first and second high-frequency radiators. In this way, the provided antenna module is applied to a smart phone, a tablet computer, or a laptop computer equipped with a metal shell.

It is to be understood that both the foregoing general description and the following detailed description are by examples, and are intended to provide further explanation of the invention as claimed.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. An antenna module comprising:

a grounding plane;

a first high-frequency radiator comprising a first feeding portion, a first grounding portion, and a first radiating portion, wherein the first grounding portion is coupled to the grounding plane;

a second high-frequency radiator comprising a second feeding portion, a second grounding portion, and a second radiating portion, wherein the second grounding portion is coupled to the grounding plane; and a low-frequency grounding component disposed between the first and second high-frequency radiators, wherein the low-frequency grounding component comprises a third grounding portion which is coupled to the grounding plane, a first coupling portion, and a second coupling portion, the low-frequency grounding component extends from the third grounding portion and extends in a first direction and a second direction of a first axis to form the first and second coupling portions respectively, and the first axis is parallel to the grounding plane, the first direction is opposite to the second direction, and the first radiating portion extending in the first direction is coupled with the first coupling portion, the second radiating portion extending in the second direction is coupled with the second coupling portion, wherein the first and second radiating portions are located at a side of the low-frequency grounding component where the first and second coupling portions face the third grounding portion in a second axis which is perpendicular to the first axis and parallel to the grounding plan;

the antenna module further comprising a metal shell, wherein the first high-frequency radiator, the second high-frequency radiator, and the low-frequency grounding component are located in the metal shell, and wherein the metal shell comprises an opening, and the first high-frequency radiator, the second high-frequency radiator, and the low-frequency grounding component are located between the opening and the grounding plane.

2. The antenna module of claim 1, wherein the first high-frequency radiator, the second high-frequency radiator, and the low-frequency grounding component are bent to extend in a third direction of the second axis.

3. The antenna module of claim 1, wherein the first grounding portion, the second grounding portion, and the third grounding portion are arranged in a straight row along the first axis.

4. The antenna module of claim 1, wherein top surfaces of the first radiating portion, the second radiating portion, the first coupling portion, and the second coupling portion are coplanar.

5. The antenna module of claim 1, wherein the low-frequency grounding component comprises a capacitor located among the first coupling portion, the second coupling portion, and the third grounding portion.

6. The antenna module of claim 5, wherein the capacitor is a chip capacitor, a distributed capacitor, or a lumped capacitor.

7. The antenna module of claim 1, wherein the first radiating portion and the first coupling portion are spaced by a distance equal to or less than 0.5 mm, and the second radiating portion and the second coupling portion are spaced by a distance equal to or less than 0.5 mm.

8. The antenna module of claim 1, further comprising a dielectric cap covering the opening of the metal shell.

* * * * *